US005988393A

United States Patent [19]

Hsia et al.

[11] Patent Number: 5,988,393

[45] Date of Patent: Nov. 23, 1999

[54] STORAGE BOX FOR SEMICONDUCTOR WAFERS

[75] Inventors: Jason Hsia; Jason Horng, both of Hsinchu, Taiwan

[73] Assignee: United Microelectronics Corp., Taiwan

[21] Appl. No.: 09/129,056

[22] Filed: Aug. 4, 1998

[30] Foreign Application Priority Data

Jun. 15, 1998 [TW] Taiwan ..... 87109467

[51] Int. Cl.[6] ..... B65D 85/90

[52] U.S. Cl. ..... 206/711; 206/591; 206/524; 206/832

[58] Field of Search ..... 206/710, 711, 206/591, 592, 832, 833, 524

[56] References Cited

U.S. PATENT DOCUMENTS

| | | | |
|---|---|---|---|
| 4,709,817 | 12/1987 | Keady et al. | 206/592 |
| 5,226,543 | 7/1993 | Foos et al. | 206/591 |
| 5,273,159 | 12/1993 | Gregerson | 206/711 |
| 5,366,079 | 11/1994 | Lin et al. | 206/328 |
| 5,423,422 | 6/1995 | Boire et al. | 206/711 |
| 5,551,571 | 9/1996 | Lin et al. | 206/710 |
| 5,577,616 | 11/1996 | Liang | 206/710 |
| 5,706,951 | 1/1998 | Oinuma et al. | 206/592 |
| 5,759,006 | 6/1998 | Miyamoto et al. | 414/416 |
| 5,803,269 | 9/1998 | Jacoby et al. | 206/711 |

*Primary Examiner*—Paul T. Sewell
*Assistant Examiner*—J. Mohandesi
*Attorney, Agent, or Firm*—Thomas, Kayden, Horstemeyer & Risley, LLP

[57] ABSTRACT

A storage box is provided for the safe-keeping of fabricated or semi-fabricated semiconductor wafers. This wafer storage box allows the wafers to be tightly secured in position when held in the storage box for storage or shipping without the possibility of breaking the wafers as in the prior art. The wafer storage box includes a receptacle member having a first piece of soft material such as anti-static sponge on the inside thereof, a holding member which is accommodated in the receptacle member, and a covering member having a second piece of soft material such as anti-static sponge on the inside thereof. When the covering member is mounted on the receptacle member, the first and second pieces of anti-static sponge are disposed on opposite sides of the holding member, thus pressing against the wafers to secure them in position in the storage box. The use of the anti-static sponge for securing purposes prevents the wafers from breaking into pieces, as otherwise occasionally occurs when using clasping pieces as seen in the prior art.

2 Claims, 2 Drawing Sheets

STORAGE BOX FOR SEMICONDUCTOR WAFERS

CROSS-REFERENCE TO RELATED APPLICATION

This application claims the priority benefit of Taiwan application serial no. 87109467, filed Jun. 15, 1998, the full disclosure of which is incorporated herein by reference.

BACKGROUND OF THE INVENTION

1. Field of the Invention

This invention relates to semiconductors, and more particularly, to the structure of a storage box used to hold a batch of semiconductor wafers, whether fabricated or semi-fabricated, therein for storing or shipping the wafers.

2. Description of Related Art

FIG. 1 is a schematic diagram showing a conventional storage box for semiconductor wafers. As shown, the conventional wafer storage box includes three main parts: a covering member 10, a holding member 40, and a receptacle member 50. The receptacle member 50 is made from anti-static plastics and has a bottom and four upright sides without a top to define an empty interior that can be used to accommodate the holding member 40 therein. The holding member 40 is an integrally formed member including two oppositely arranged wall portions 42 linked by a beam portion 44 on the side, with each of the wall portions 42 being further formed with a row of parallel-spaced separators (each being a flat plate) 32 to define a plurality of parallel slots 22.

The covering member 10 has a top and four upright sides without a bottom to define an empty interior slightly larger in dimensions than the receptacle member 50 so that the four upright sides of the receptacle member 50 can be fitted snugly therein when the covering member 10 is used to cover the receptacle member 50. Further, the covering member 10 is provided with two rows of oppositely arranged and parallel-spaced clasping pieces 20, 30 on the inner face 12 of the top. Each neighboring pair of the clasping pieces 20, 30 define a slot therebetween to clasp one wafer (not shown) in position.

In use, the first step is to place the holding member 40 in the receptacle member 50. Then, each of the wafers is inserted into one of the slots 22 defined by the separators 32 on the wall portions 42 of the holding member 40. Finally, the covering member 10 is mounted on the receptacle member 50, with the clasping pieces 20, 30 on the inside of the covering member 10 securely clasping the wafers held in the holding member 40.

One drawback to the foregoing storage box structure, however, is that, in the case that any pair of the clasping pieces 20, 30 on the covering member 10 are not aligned precisely with the corresponding slots 22 on the holding member 40, the wafers held therein may be smashed to pieces when the technician is trying to mount the covering member 10 on the receptacle member 50.

SUMMARY OF THE INVENTION

It is therefore an objective of the present invention to provide an improved storage box for semiconductor wafers, which allows the wafers to be tightly secured in position when held in the storage box for storage or shipping without the possibility of breaking the wafers as in the prior art.

In accordance with the foregoing and other objectives of the present invention, an improved wafer storage box is provided. The wafer storage box of the invention includes the following constituent parts: a receptacle member having a first piece of soft material such as anti-static sponge on the inside thereof, a holding member which is accommodated in the receptacle member when the storage box is in use, and a covering member having a second piece of soft material on the inside thereof, which covers, the receptacle member when the storage box is in use, and in which case the first and second pieces of soft material are disposed on opposite sides of the holding member.

It is a characteristic feature of the invention that, when the covering member is mounted on the receptacle member, the wafers held in the holding member will be pressed by the two opposing pieces of anti-static sponge, thereby allowing the wafers to be securely held in position when shipping.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 2:
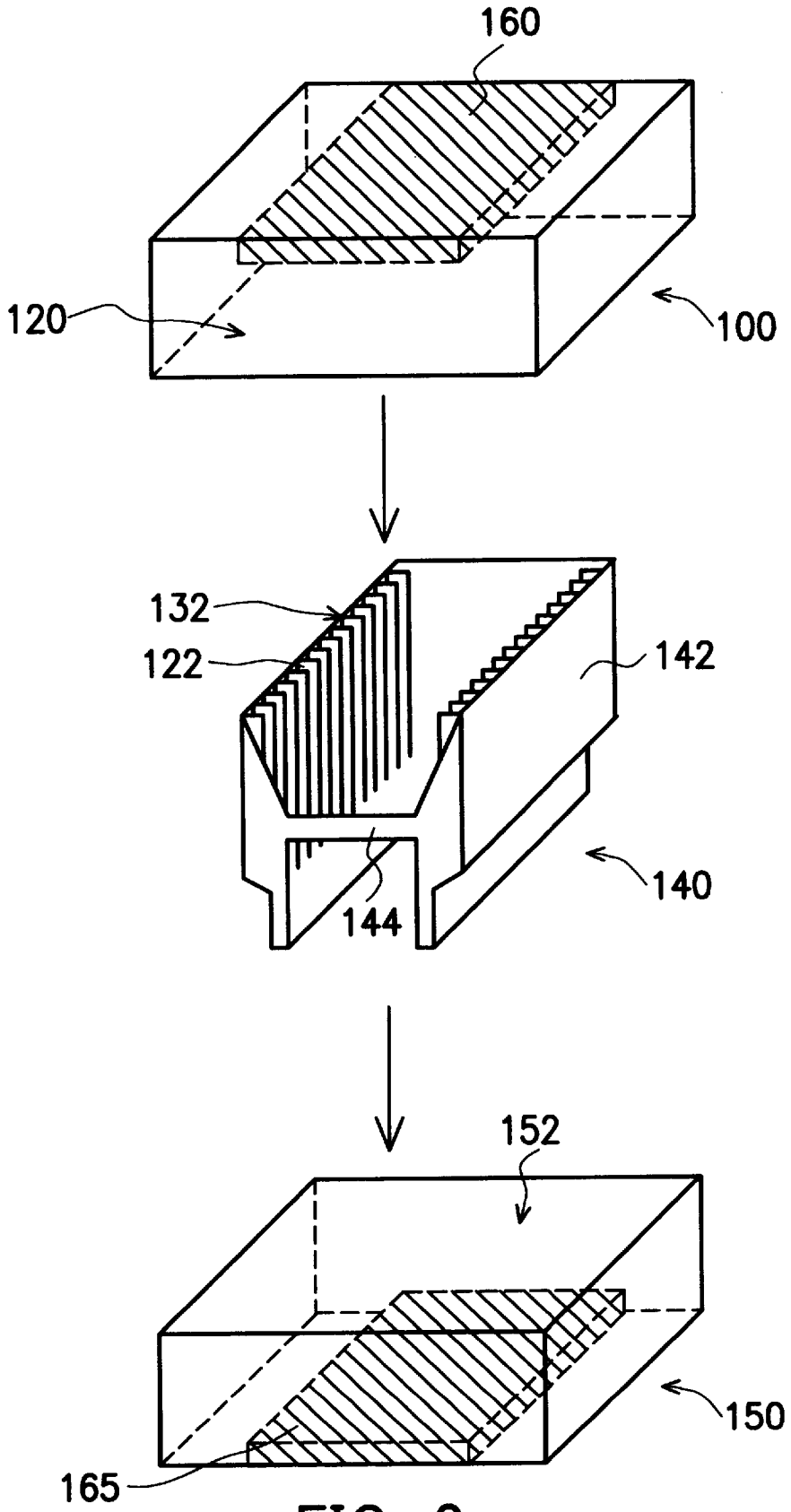
FIG. 2 is a schematic diagram showing the storage box of the invention for holding semiconductor wafers.

FIG. 2 is a schematic diagram showing the storage box of the invention for holding semiconductor wafers. As shown, the wafer storage box of the invention includes three main parts: a covering member 100, and a holding member 140, and a receptacle member 150. The receptacle member 150 is made from anti-static plastics and has a bottom side and four upright sides without a top to define an empty interior that can be used to accommodate the holding member 140 therein. Further, the receptacle member 150 includes a first piece of anti-static sponge 165 on the inner face 152 of the bottom.

Figure 1:
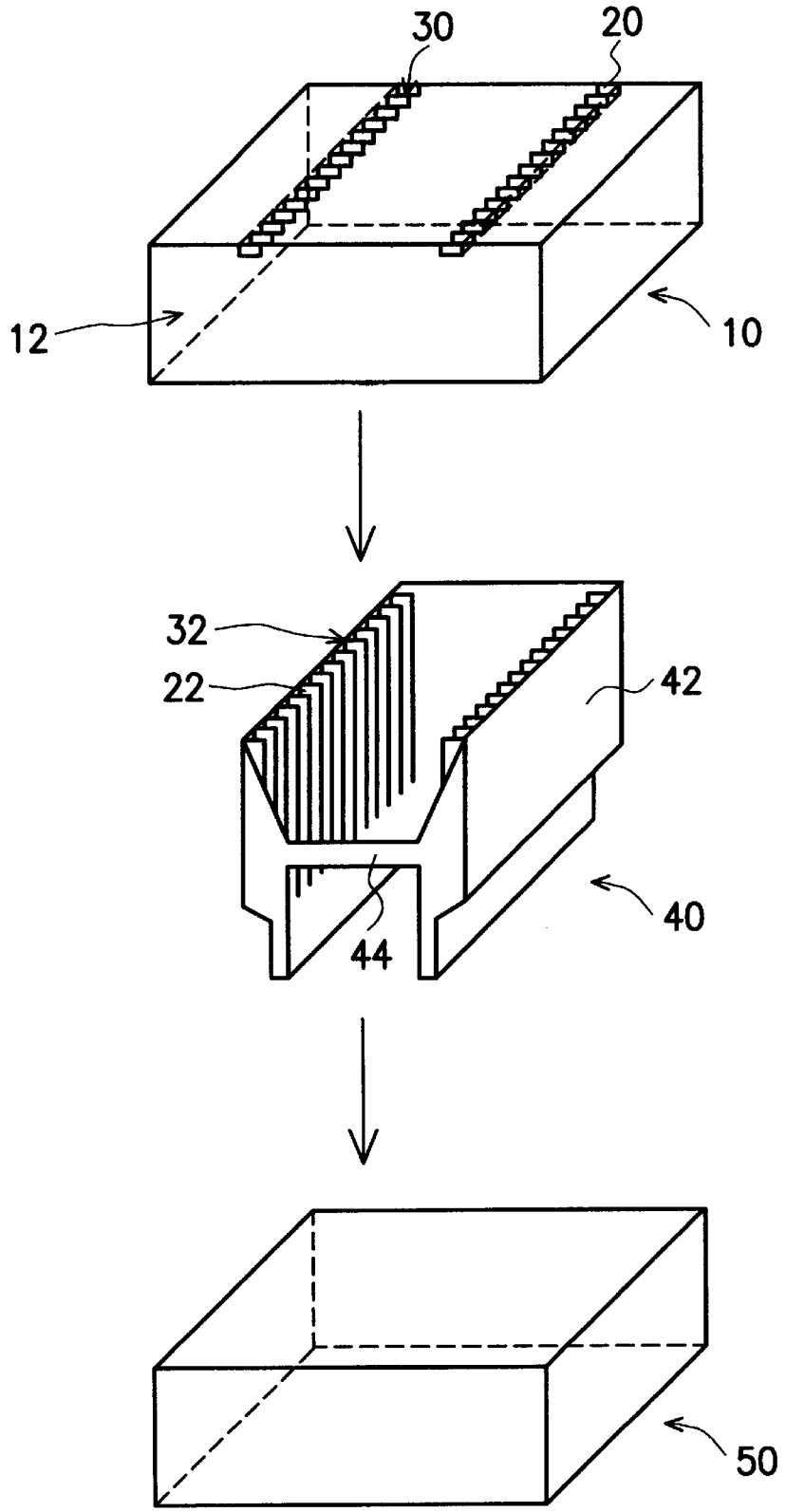
FIG. 1 (PRIOR ART)
FIG. 1 is a schematic diagram showing a conventional storage box for holding semiconductor wafers.

The holding member 140 is an integrally formed member including two oppositely arranged wall portions 142 linked by a beam portion 144 on the side, with each of the wall portions 142 being further formed with a row of parallel-spaced separators (each being a flat plate) 132 to define a plurality of parallel slots 122. The holding member 140 here is entirely identical in structure to the holding member 40 in the prior art of FIG. 1.

The covering member 100 has a top and four upright sides without a bottom to define an empty interior slightly larger in dimensions than the receptacle member 150 so that the four upright sides of the receptacle member 150 can be fitted snugly therein when the covering member 100 is used to cover the receptacle member 150. Further, the covering member 100 is provided with a second piece of anti-static sponge 160 on the inner face 120 of the top.

In use, the first step is to place the holding member 140 on the first piece of anti-static sponge 165 in the receptacle member 150, then insert each of the wafers (not shown) in one of the slots 122 defined by the separators 132 on the wall portions 142 of the holding member 140, and finally mount the covering member 100 on the receptacle member 150, with the second piece of anti-static sponge 160 pressing on the wafers (not shown) held in the holding member 140.

It is a characteristic feature of the invention that, when the covering member 100 is mounted on the receptacle member

150, the wafers (not shown) held in the holding member 140 will be forcibly pressed by the two opposing pieces of anti-static sponge 160, 165, allowing these wafers (not shown) to be securely held in position when shipping. Since the two pieces of anti-static sponge 160, 165 are soft in material quality, they will not cause any stress that would break the wafers.

The drawback of the prior art is thus eliminated. The wafer storage box of the invention is thus more advantageous in use than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A container for safely storing a plurality of fragile disc shaped objects comprising:

a receptacle member integrally constructed of anti-static plastic having a bottom side and four upright sides that define an open top and a first interior space;

a holding member integrally formed to define two oppositely disposed wall portions interconnected by a cross beam, the holding member further defining a plurality of slots for holding a plurality of disc-shaped objects in a closely-spaced, parallel disposition, the holding member being disposed within the first interior space when the storage container is in use and being dimensioned to closely fit between the four upright sides;

a covering member integrally constructed having a top and four sides depending therefrom to define an open bottom and a second interior space, the covering member being dimensioned so that the four depending sides snugly engage the four upright sides of the receptacle member when in use to form a composite interior space, the composite interior space defined by the first interior space and the second interior space collectively, the composite interior space defining a space in which the holding member and the plurality of disc-shaped objects are safely contained;

a first anti-static sponge permanently affixed to an inner face of the receptacle member bottom side, the first anti-static sponge being rectilinear and having a planar face, when not in use, for engaging the disc-shaped objects; and a second anti-static sponge permanently affixed to an inner face of the covering member top side, the second anti-static sponge being rectilinear and having a planar face, when not in use, for engaging the disc-shaped objects;

wherein, when in use, the first and second anti-static sponges softly engage outer edges of the plurality of disc-shaped objects held in the slots of the holding member to securely, but safely, store the plurality of disc-shaped objects.

2. The container as defined in claim 1, wherein the disc-shaped objects are semiconductor wafers.

* * * * *